US010260470B2

(12) United States Patent
Kaneta

(10) Patent No.: US 10,260,470 B2
(45) **Date of Patent: *Apr. 16, 2019**

(54) FUEL INJECTOR

(71) Applicant: DENSO CORPORATION, Kariya, Aichi-pref. (JP)

(72) Inventor: Hiroki Kaneta, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/792,788

(22) Filed: Oct. 25, 2017

(65) Prior Publication Data

US 2018/0045157 A1 Feb. 15, 2018

Related U.S. Application Data

(63) Continuation of application No. 14/909,265, filed as application No. PCT/JP2014/003967 on Jul. 29, 2014, now Pat. No. 9,828,961.

(30) Foreign Application Priority Data

Aug. 2, 2013 (JP) ..... 2013-161594

(51) Int. Cl.
*F02M 61/18* (2006.01)

(52) U.S. Cl.
CPC .... *F02M 61/1846* (2013.01); *F02M 61/1826* (2013.01); *F02M 61/1833* (2013.01)

(58) Field of Classification Search
CPC ..... F02M 61/1846; F02M 61/1833; F02M 61/1826; F02M 61/184; F02M 61/1806
USPC ..... 123/470; 239/533.12
See application file for complete search history.

(56) References Cited

U.S. PATENT DOCUMENTS 5,163,621 A * 11/1992 Kato ..... F02M 61/163 239/533.12
6,422,198 B1 * 7/2002 VanBrocklin ..... B05B 1/14 123/294
6,644,565 B2 * 11/2003 Hockenberger ... F02M 61/1806 239/533.12

(Continued)

FOREIGN PATENT DOCUMENTS

JP H1-208563 8/1989
JP 5-21168 3/1993

(Continued)

OTHER PUBLICATIONS

International Search Report for PCT/JP2014/003967 dated Oct. 28, 2014, 5 pages.

(Continued)

*Primary Examiner* — Hai H Huynh
(74) *Attorney, Agent, or Firm* — Nixon & Vanderhye P.C.

(57) ABSTRACT

In a fuel injector 10, a first injection hole 155*a* and a second injection hole 155*b* having reference inside diameters Dn1, Dn2 different from each other are formed as a plurality of injection holes 155. In such a configuration, an L/D value obtained by dividing the flow channel length Ln1 of the first injection hole 155*a* by the reference inside diameter Dn1 of the first injection hole 155*a* agrees to an L/D value obtained by dividing the flow channel length Ln2 of the second injection hole 155*b* by the reference inside diameter Dn2 of the second injection hole 155*b*.

4 Claims, 9 Drawing Sheets

(56) References Cited

U.S. PATENT DOCUMENTS

| | | | | |
|---|---|---|---|---|
| 6,826,833 | B1 * | 12/2004 | Maier | B23P 15/16 239/463 |
| 8,016,214 | B2 | 9/2011 | Higuma | |
| 9,599,083 | B2 * | 3/2017 | Ishii | F02M 51/0671 |
| 9,599,084 | B2 * | 3/2017 | Kochanowski | F02M 51/0671 |
| 9,677,526 | B2 * | 6/2017 | Yasukawa | F02M 51/0671 |
| 2001/0025892 | A1 * | 10/2001 | McCoy | F02B 43/00 239/589 |
| 2003/0234006 | A1 | 12/2003 | Saito et al. | |
| 2004/0021014 | A1 * | 2/2004 | Pilgram | F02M 51/0664 239/533.12 |
| 2007/0057093 | A1 * | 3/2007 | Gunji | B21J 5/10 239/533.12 |
| 2007/0095952 | A1 * | 5/2007 | Heinstein | F02M 51/0671 239/585.1 |
| 2008/0196691 | A1 | 8/2008 | Kihara et al. | |
| 2009/0020633 | A1 * | 1/2009 | Limmer | F02M 61/1806 239/533.12 |
| 2009/0242670 | A1 | 10/2009 | Kato et al. | |
| 2010/0193612 | A1 * | 8/2010 | Schrade | F02M 51/0671 239/533.12 |
| 2016/0195052 | A1 | 7/2016 | Kaneta | |

FOREIGN PATENT DOCUMENTS

| | | |
|---|---|---|
| JP | 2000-073917 | 3/2000 |
| JP | 2004-204808 | 7/2004 |
| JP | 2009-209742 | 9/2009 |
| JP | 5033735 | 9/2012 |
| JP | 2012-246897 | 12/2012 |

OTHER PUBLICATIONS

Written Opinion of the ISA for PCT/JP2014/003967 dated Oct. 28, 2014, 8 pages.

* cited by examiner

FUEL INJECTOR

CROSS REFERENCE TO RELATED APPLICATION

This application is a continuation application of application Ser. No. 14/909,265, filed Feb. 1, 2016, which is the U.S. national phase of International Application No. PCT/JP2014/003967 filed Jul. 29, 2014 which designated the U.S. and claims priority to Japanese Patent Application No. 2013-161594 filed on Aug. 2, 2013, the entire contents of each of which are hereby incorporated by reference.

TECHNICAL FIELD

The present disclosure relates to a fuel injector that injects fuel toward the inside of a combustion chamber of an internal combustion engine.

BACKGROUND ART

In the fuel injector disclosed in Patent Literatures 1 and 2, a plurality of injection ports which inject fuel toward the inside of the combustion chamber are formed. In the fuel injector of Patent Literature 2 in particular, the inside diameter of one injection port is different from the inside diameter of the other injection port. According to the configuration in which the inside diameter of the injection ports is made to differ from each other thus, the shape of the spray injected from the fuel injector becomes easily suitable to the shape of the combustion chamber of the internal combustion engine.

However, when the inside diameter of one injection port is different from the inside diameter of the other injection hole as the fuel injector disclosed in Patent Literature 2, the property of the spray injected from each injection hole also possibly differs from each other. Therefore, the particle diameter of the fuel injected from each injection hole possibly differs from each other, or the spreading style of the spray injected from each injection hole possibly differs from each other.

It is an object of the present disclosure to provide a fuel injector that can make the property of the spray injected from each injection hole approximate to each other even when the inside diameter of the injection holes formed in the fuel injector may differ from each other.

PRIOR ART LITERATURES

Patent Literature

[Patent Literature 1] Japanese Patent No. 5,033,735
[Patent Literature 2] JP-2008-202483A

SUMMARY OF INVENTION

According to a first aspect of the present disclosure, a plurality of injection holes formed in a fuel injector include a first injection hole and a second injection hole having the reference inside diameter different from each other. A value obtained by dividing the flow channel length of the first injection hole by the reference inside diameter of the first injection hole becomes equal to a value obtained by dividing the flow channel length of the second injection hole by the reference inside diameter of the second injection hole.

The present inventors found out that the atomizing property of the spray in the fuel injector was related to the ratio of the flow channel length and the reference inside diameter of the injection hole. Therefore, in the first aspect, the value obtained by dividing the flow channel length by the reference inside diameter is the same as in the first injection hole and the second injection hole. Accordingly, even when the reference inside diameter in these injection holes may differ from each other, the atomizing properties of the first injection hole and the second injection hole possibly approximate to each other. The fuel injector can reduce the dispersion of the particle diameter with respect to the spray injected from each injection hole also while forming the spray shape that is suitable to the combustion chamber of the internal combustion engine.

Also, the present inventors found out the relationship between the change rate of the spray injected from the injection hole and the value obtained by dividing the flow channel length by the reference inside diameter. According to a second aspect of the present disclosure, the first injection hole and the second injection hole have a tubular hole shape that extends while maintaining each reference inside diameter, and both of the value obtained by dividing the flow channel length of the first injection hole by the reference inside diameter of the first injection hole and the value obtained by dividing the flow channel length of the second injection hole by the reference inside diameter of the second injection hole are 1.45 or more.

According to a third aspect of the present disclosure, the first injection hole and the second injection hole have a tapered hole shape that expands the diameter from each reference inside diameter starting from the fuel upstream side toward the fuel downstream side, and both of the value obtained by dividing the flow channel length of the first injection hole by the reference inside diameter of the first injection hole and the value obtained by dividing the flow channel length of the second injection hole by the reference inside diameter of the second injection hole are 2.0 or more.

When the flow channel length with respect to the reference inside diameter has been secured, the rectifying action occurs in the fuel that flows inside the injection hole. Therefore, the spray injected from the injection hole is stably formed in the center line direction of the injection hole. By securing the predetermined value described above or more of the value obtained by dividing the flow channel length by the reference inside diameter, even when the reference inside diameter of the first injection hole and the second injection hole may differ from each other, the change rate of the spray injected from these injection holes becomes a value that is approximate to each other and stable. Therefore, the fuel injector can stably form the spray of the shape that is suitable to the combustion chamber of the internal combustion engine.

Also, the present inventors found out that there was a correlation between the length of the spray (hereinafter referred to as "spray length") injected from the injection hole whose reference inside diameter was maintained and the value obtained by dividing the flow channel length by the reference inside diameter. Therefore, according to a fourth aspect of the present disclosure, both of the value obtained by dividing the flow channel length of the first injection hole by the reference inside diameter of the first injection hole and the value obtained by dividing the flow channel length of the second injection hole by the reference inside diameter of the second injection hole are made 1.85 or less.

By stipulating the upper limit of the flow channel length with respect to the reference inside diameter, the event that the fuel flowing inside the injection hole is rectified excessively can be avoided. By setting the upper limit of the value obtained by dividing the flow channel length by the reference inside diameter, even when the reference inside diameters of the first injection hole and the second injection hole may differ from each other, the spray length of the fuel injected from these injection holes can be suppressed for the both. Therefore, the fuel injector can form the spray of the shape more suitable to the combustion chamber of the internal combustion engine.

BRIEF DESCRIPTION OF DRAWINGS

The object described above, other objects, the features and advantages with respect to the present disclosure will be clarified more by detailed description below while referring to the attached drawings.

EMBODIMENTS FOR CARRYING OUT INVENTION

Below, embodiments will be explained based on the drawings. By giving a same reference sign to a corresponding configuration element in each embodiment, there is a case of omitting duplicated explanation. When only a portion of the configuration is explained in each embodiment, with respect to the other portion of the configuration in question, the configuration of other embodiment explained previously can be applied. Also, not only the combination of the configurations explicitly shown in the explanation of each embodiment, the configurations of embodiments can be combined with each other partially even it is not explicitly shown unless a problem occurs particularly in the combination. Further, the combination not explicitly shown of the configurations described in embodiments and modifications also is to be understood to have been disclosed by the explanation below.

First Embodiment

Figure 1:
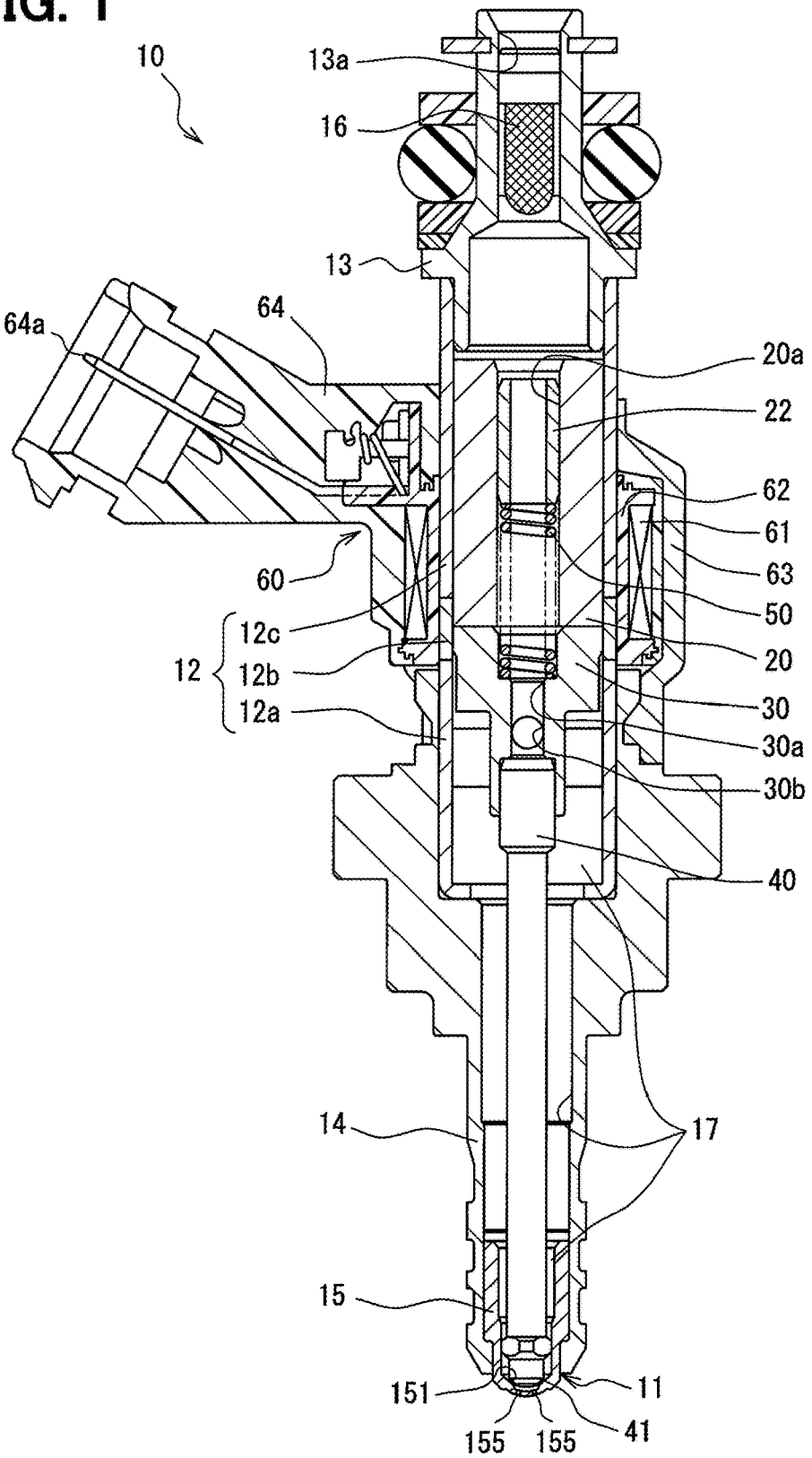
FIG. 1 is a cross-sectional view showing a fuel injector according to a first embodiment.

A fuel injector 10 according to a first embodiment shown in FIG. 1 is installed in a gasoline engine, and injects fuel toward the inside of a combustion chamber (not illustrated) that is arranged in the gasoline engine. The fuel injector 10 may be one that injects fuel to an intake passage that communicates with the combustion chamber of a gasoline engine, and may be one that injects fuel to the combustion chamber of a diesel engine.

The fuel injector 10 includes a valve body 11, a fixed core 20, a movable core 30, a valve member 40, an elastic member 50, and a drive unit 60.

The valve body 11 is formed of a core housing 12, an inlet member 13, a nozzle holder 14, a nozzle body 15, and the like. The core housing 12 is formed into a cylindrical shape, and includes a first magnetic section 12*a*, a non-magnetic section 12*b*, and a second magnetic section 12*c* in this order from one end side to the other end side of the axial direction. The respective magnetic sections 12*a*, 12*c* formed of a magnetic material and the non-magnetic section 12*b* formed of a non-magnetic material are joined with each other by laser welding and the like. The non-magnetic section 12*b* prevents the magnetic flux from being short-circuited between the first magnetic section 12*a* and the second magnetic section 12*c*.

To one end of the first magnetic section 12*a*, the inlet member 13 of a cylindrical shape is fixed. The inlet member 13 forms a fuel inlet 13*a* to which the fuel is supplied from a fuel pump (not illustrated). A fuel filter 16 is fixed to the inner peripheral side of the inlet member 13 in order to filter the supply fuel to the fuel inlet 13*a* and to introduce the supply fuel into the core housing 12 of the downstream side.

Figure 2:
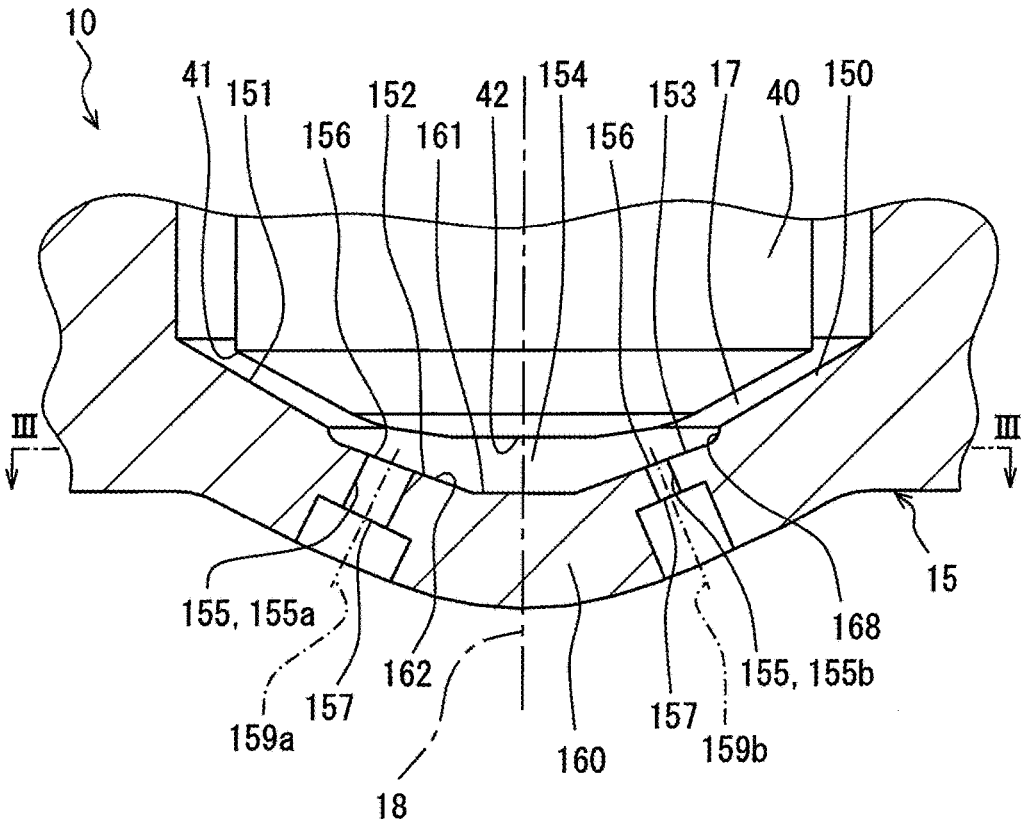
FIG. 2 is a cross-sectional view in which the vicinity of a sack section is enlarged.

To one end of the first magnetic section 12*a*, the nozzle body 15 is fixed through the nozzle holder 14 that is formed into a cylindrical shape by a magnetic material. The nozzle body 15 is formed into a bottomed cylindrical shape, and forms a fuel passage 17 on the inner peripheral side jointly with the core housing 12 and the nozzle holder 14. As shown in FIG. 2, the nozzle body 15 includes a valve seat section 150 and a sack section 152.

Figure 3:
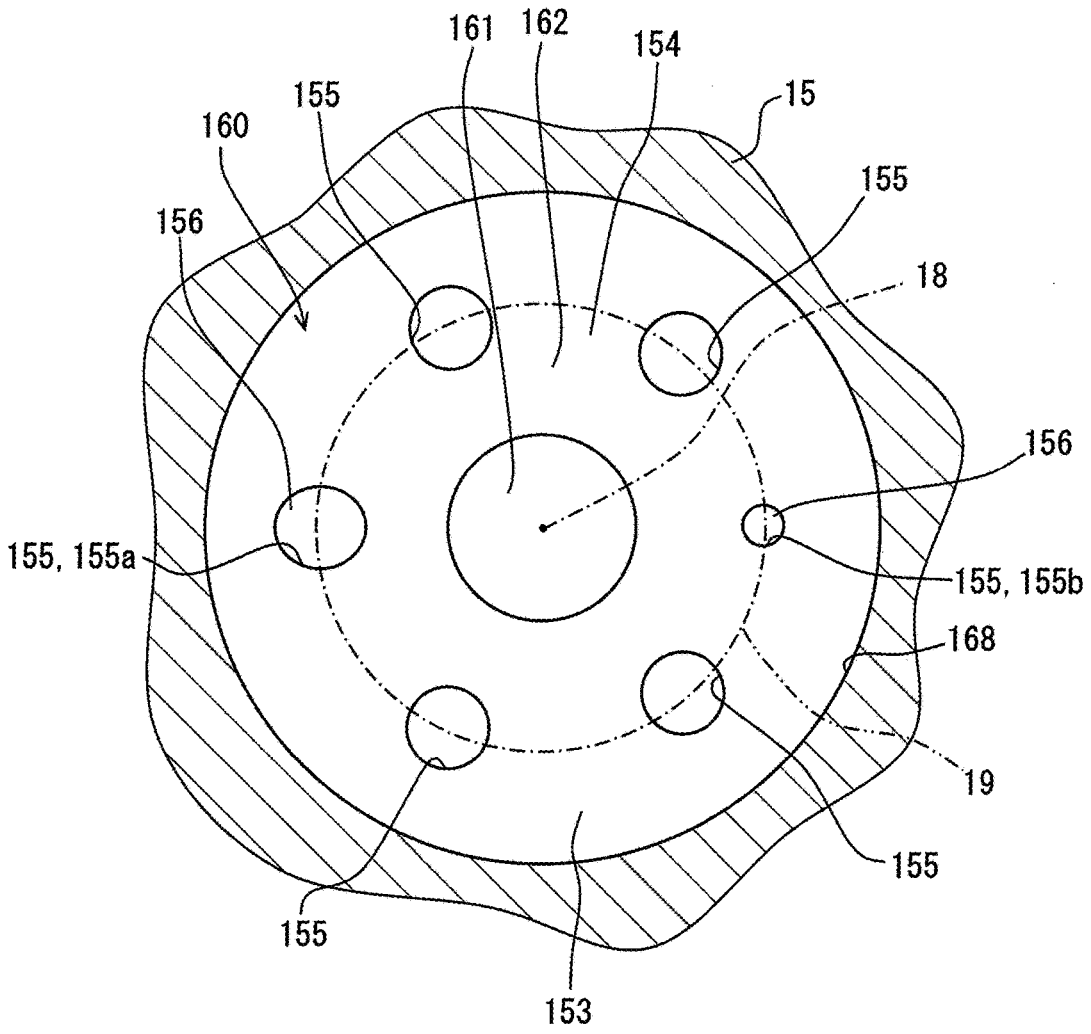
FIG. 3 is a cross-sectional view taken along the line of FIG. 2.

The valve seat section 150 forms a valve seat surface 151 by the inner peripheral surface of a tapered surface shape that reduces the diameter at a constant diameter reduction rate toward the fuel downstream side. The sack section 152 is formed on the fuel downstream side of the valve seat section 150. The sack section 152 forms a recess 153 that opens toward the fuel passage 17. To the inner surface of a sack chamber 154, injection holes 155 that communicate with the sack chamber 154 open. As shown in FIGS. 2, 3, the plurality of injection holes 155 are arranged so as to be apart from each other around an axis 18 of the nozzle body 15. Respective inlet side openings 156 of the respective injection holes 155 are positioned on a same imaginal circle 19 around the axis 18. Also, the respective injection holes 155 incline toward the outer peripheral side of the recess 153 toward respective outlet side openings 157.

As shown in FIG. 1, the fixed core 20 is formed into a cylindrical shape by a magnetic material, and is fixed to the inner peripheral surface of the non-magnetic section 12*b* and the second magnetic section 12*c* out of the core housing 12 coaxially. In the fixed core 20, a through hole 20*a* is arranged which penetrates the center part in the radial direction thereof in the axial direction. The fuel flowing in from the fuel inlet 13*a* to the through hole 20*a* through the fuel filter 16 flows inside the through hole 20*a* toward the movable core 30 side.

The movable core 30 is formed into a stepped cylindrical shape by a magnetic material, is disposed on the inner peripheral side of the core housing 12 coaxially, and opposes the fixed core 20 of the fuel upstream side in the axial direction. The movable core 30 is capable of executing precise reciprocating motion to both sides in the axial direction by being guided by the inner peripheral wall of the non-magnetic section 12*b* out of the core housing 12. In the movable core 30, a first through hole 30*a* that penetrates the center part in the radial direction thereof in the axial direction and a second through hole 30*b* that penetrates the middle part in the axial direction in the radial direction and communicates with the first through hole 30*a* are arranged. The fuel having flowed out from the through hole 20*a* of the fixed core 20 flows in to the first through hole 30*a* of the movable core 30, and flows from the second through hole 30*b* to the fuel passage 17 of the inside of the core housing 12.

The valve member 40 is formed into a needle shape with the circular cross section by a non-magnetic material. The elements 12, 14, 15 out of the body member 11 are disposed inside the fuel passage 17 coaxially. One end of the valve member 40 is fixed to the inner peripheral surface of the first through hole 30*a* of the movable core 30 coaxially. Also, as shown in FIGS. 1, 2, the other end of the valve member 40 forms an abutting section 41 that reduces the diameter toward the fuel downstream side and makes the abutting section 41 abuttably oppose the valve seat surface 151. The valve member 40 makes the abutting section 41 depart from and sit on the valve seat surface 151 by displacement along the axis 18. Thus, fuel injection from the injection holes 155 is continued/discontinued. More specifically, at the time of the valve opening operation when the valve member 40 makes the abutting section 41 depart from the valve seat surface 151, the fuel flows in from the fuel passage 17 to the sack chamber 154, and is injected from the respective injection holes 155 to the combustion chamber. On the other hand, at the time of the valve closing operation when the valve member 40 makes the abutting section 41 sit on the valve seat surface 151, fuel injection from the respective injection holes 155 to the combustion chamber is blocked.

As shown in FIG. 1, the elastic member 50 is formed of a compression coil spring made of metal, and is stored coaxially on the inner peripheral side of the through hole 20*a* that is arranged in the fixed core 20. One end of the elastic member 50 is locked to an end in the axial direction of an adjusting pipe 22 that is fixed to the inner peripheral surface of the through hole 20*a*. The other end of the elastic member 50 is locked to the inner surface of the first through hole 30*a* out of the movable core 30. The elastic member 50 is elastically deformed by being compressed between the elements 22, 30 that sandwich it. Therefore, the restoring force generated by the elastic deformation of the elastic member 50 becomes an energizing force that energizes the movable core 30 to the fuel downstream side jointly with the valve member 40.

The drive unit 60 is formed of a coil 61, a resin bobbin 62, a magnetic yoke 63, a connector 64, and the like. The coil 61 is formed by winding a metal wire around the resin bobbin 62, and the magnetic yoke is disposed on the outer peripheral side thereof. The coil 61 is fixed coaxially to the outer peripheral surfaces of the non-magnetic section 12*b* and the second magnetic section 12*c* which become the outer peripheral side of the fixed core 20 out of the core housing 12 through the resin bobbin 62. The coil 61 is electrically connected to the external control circuit (not illustrated) through a terminal 64*a* arranged in the connector 64, and is configured to be energization-controlled by the control circuit.

Here, when the coil 61 is magnetized by energization, the magnetic flux flows in a magnetic circuit that is formed jointly by the magnetic yoke 63, the nozzle holder 14, the first magnetic section 12*a*, the movable core 30, the fixed core 20, and the second magnetic section 12*c*. As a result, a magnetic attraction force that attracts the movable core 30 toward the fixed core 20 of the fuel upstream side is generated between the movable core 30 and the fixed core 20. On the other hand, when the coil is demagnetized by stop of energization, the magnetic flux does not flow in the magnetic circuit described above, and the magnetic attraction force is eliminated between the movable core 30 and the fixed core 20.

In the valve opening operation of the fuel injector 10, the magnetic attraction force is applied to the movable core 30 by start of energization to the coil 61. Then, the movable core 30 moves to the fixed core 20 side along with the valve member 40 resisting the restoring force of the elastic member 50, thereby abuts upon the fixed core 20, and stops. As a result, because the abutting section 41 becomes a state of departing from the valve seat surface 151, the fuel comes to be injected from the respective injection holes 155.

In the valve closing operation of the fuel injector 10 after the valve opening operation, the magnetic attraction force applied to the movable core 30 is eliminated by stopping energization of the coil 61. The movable core 30 moves to the energizing side along with the valve member 40 by the restoring force of the elastic member 50, and makes the valve member 40 abut upon the valve seat surface 151 and stop. As a result, the abutting section 41 becomes a state of sitting on the valve seat surface 151, and fuel injection from the respective injection holes 155 stops.

Next, the configuration of the vicinity of the recess 153 shown in FIGS. 2, 3 will be explained in detail. A bottom wall 160 of the recess 153 is formed so as to oppose the valve member 40 at a distance, the valve member 40 making the abutting section 41 sit on the valve seat surface 151. Between a distal end surface 42 of the valve member 40 and the bottom wall 160 at the time the abutting section 41 sits on the valve seat surface 151, the sack chamber 154 that communicates with the respective injection holes 155 is formed. The volume of the sack chamber 154 is stipulated so that the foreign matter mixed in to the fuel can be suppressed from being bitten between the valve member 40 and the valve seat surface 151.

In the bottom surface of the bottom wall 160, a center surface section 161 and a tapered surface section 162 are formed. Also, on the outer peripheral side of the bottom surface, a connecting surface 168 is formed. The center surface section 161 is a flat surface formed into a complete round shape, and is positioned coaxially with the axis 18. The tapered surface section 162 is formed into a tapered surface shape that reduces the diameter with a constant diameter reduction rate toward the center surface section 161 that becomes the fuel downstream side out of the axial direction. The connecting surface 168 is formed into a recessed curved surface shape that increases the diameter reduction rate toward the fuel downstream side, and connects the outer peripheral side of the tapered surface section 162 and the inner peripheral side of the valve seat surface 151 with each other.

Figure 4:
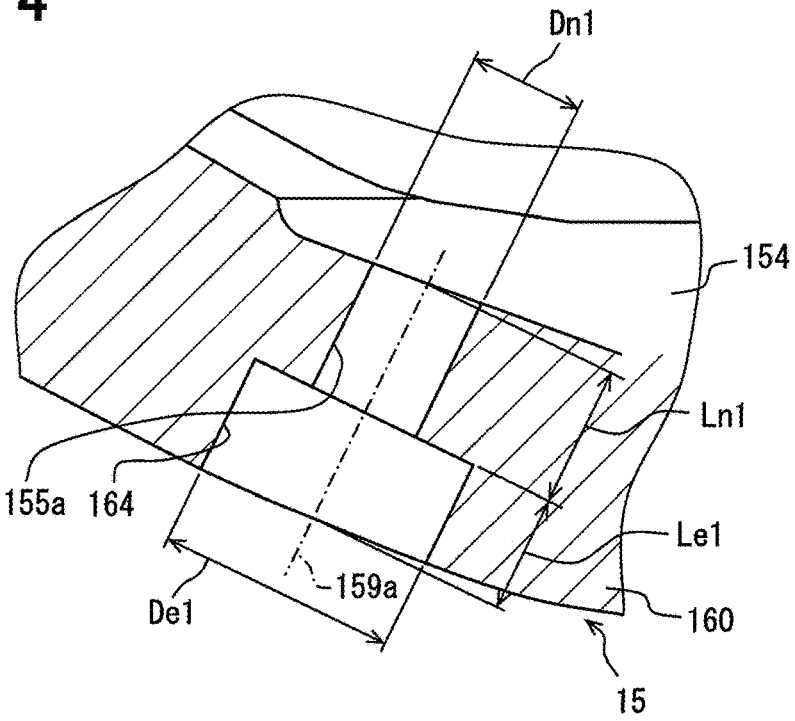
FIG. 4 is a cross-sectional view in which the vicinity of the first injection hole is further enlarged.
Figure 5:
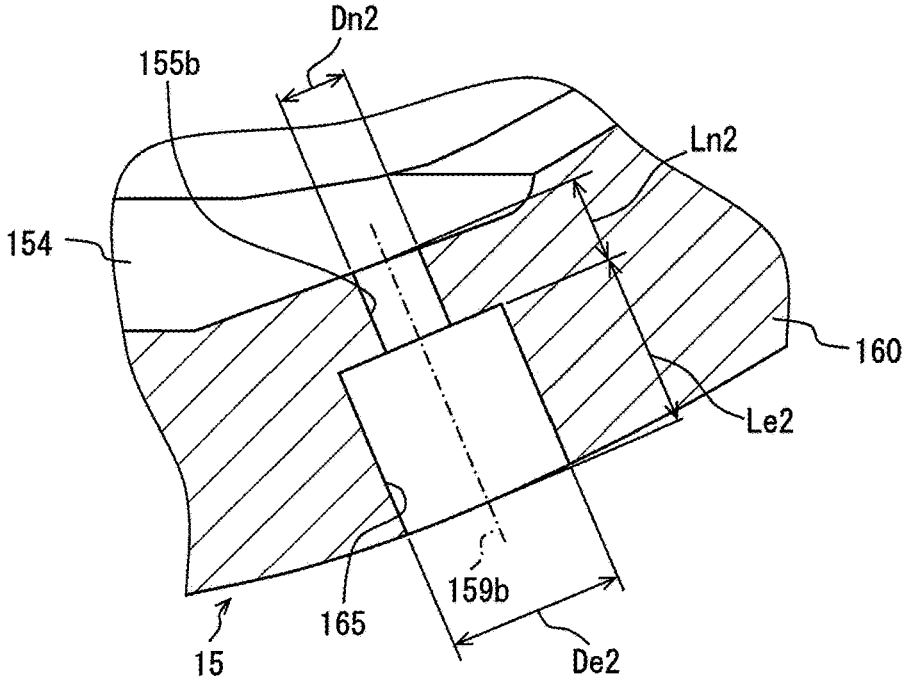
FIG. 5 is a cross-sectional view in which the vicinity of the second injection hole is further enlarged.

In the bottom wall 160, the injection holes 155 including a first injection hole 155*a* and a second injection hole 155*b* are formed. Both of the first injection hole 155*a* and the second injection hole 155*b* are formed into a cylindrical hole shape. The first injection hole 155*a* and the second injection hole 155*b* extend inside the bottom wall 160 with an attitude making the respective axes (hereinafter referred to as "injection hole axis") cross the tapered surface section 162. Respective injection hole axes 159*a* and 159*b* cross with the tapered surface section 162 diagonally, and incline toward the outer periphery of the nozzle body 15 as they go from the inlet side opening 156 toward the outlet side opening 157. The inside diameter that is maintained substantially constant in the first injection hole 155*a* shown in FIG. 4 is made a reference inside diameter Dn1. The inside diameter that is maintained substantially constant in the second injection hole 155*b* shown in FIG. 5 is made a reference inside diameter Dn2. As shown in FIGS. 4, 5, the reference inside diameter Dn1 of the first injection hole 155*a* is larger than the reference inside diameter Dn2 of the second injection hole 155*b*.

The flow channel length of the first injection hole 155*a* is expressed as Ln1, and the flow channel length of the second injection hole 155*b* is expressed as Ln2. In the present embodiment, the flow channel length Ln1 of the first injection hole 155*a* is longer than the flow channel length Ln2 of the second injection hole 155*b*. The value obtained by dividing the flow channel length Ln1 in the first injection hole 155*a* by the reference inside diameter Dn1 thereof (hereinafter referred to as "L/D value") is equal to the L/D value obtained by dividing the flow channel length Ln2 in the second injection hole 155*b* by the reference inside diameter Dn2 thereof.

In order to achieve each shape of the first injection hole 155*a* and the second injection hole 155*b* described above, in the bottom wall 160, a first expanded diameter hole 164 and a second expanded diameter hole 165 are formed so as to continue to the respective injection holes 155*a*, 155*b*. The first expanded diameter hole 164 and the second expanded diameter hole 165 shown in FIGS. 2, 4, 5 are the countersunk hole formed from the outer surface side of the bottom wall 160 toward the sack chamber 154.

The first expanded diameter hole 164 of FIG. 4 is formed into a cylindrical hole shape that extends along the injection hole axis 159*a*, and is positioned coaxially with the first injection hole 155*a*. The first expanded diameter hole 164 arranged on the fuel downstream side of the first injection hole 155*a* makes the first injection hole 155*a* communicate with the outside of the nozzle body 15. In order that the flow channel area of the expanded diameter hole 164 becomes larger than the flow channel area of the first injection hole 155*a*, the inside diameter De1 of the first expanded diameter hole 164 is stipulated to be a larger diameter than the reference inside diameter Dn1 of the first injection hole 155*a*. Also, the flow channel length Le1 of the first expanded diameter hole 164 is stipulated so as to be equal to the difference of the wall thickness of the bottom wall 160 along the injection hole axis 159*a* of the first injection hole 155*a* and the flow channel length Ln1 of the first injection hole 155*a*, and complements this difference of the flow channel length Ln1 and the wall thickness.

The second expanded diameter hole 165 of FIG. 5 is formed into a cylindrical hole shape that extends along the injection hole axis 159*b*, and is positioned coaxially with the second injection hole 155*b*. The second expanded diameter hole 165 arranged on the fuel downstream side of the second injection hole 155*b* makes the second injection hole 155*b* communicate with the outside of the nozzle body 15. In order that the flow channel area of the expanded diameter hole 165 becomes larger than the flow channel area of the second injection hole 155*b*, the inside diameter De2 of the second expanded diameter hole 165 is stipulated to be a larger diameter than the reference inside diameter Dn2 of the second injection hole 155*b*. Also, the flow channel length Le2 of the second expanded diameter hole 165 is stipulated so as to be equal to the difference of the wall thickness of the bottom wall 160 along the injection hole axis 159*b* of the second injection hole 155*b* and the flow channel length Ln2 of the second injection hole 155*b*, and complements this difference of the flow channel length Ln2 and the wall thickness of the bottom wall 160.

Next, respective L/D values of the first injection hole 155*a* and the second injection hole 155*b* will be explained in detail based on FIG. 6. Also, in FIG. 6, a pair of the broken lines disposed so as to sandwich the solid line express the range of the upper limit and the lower limit of the dispersion respectively.

Figure 6:
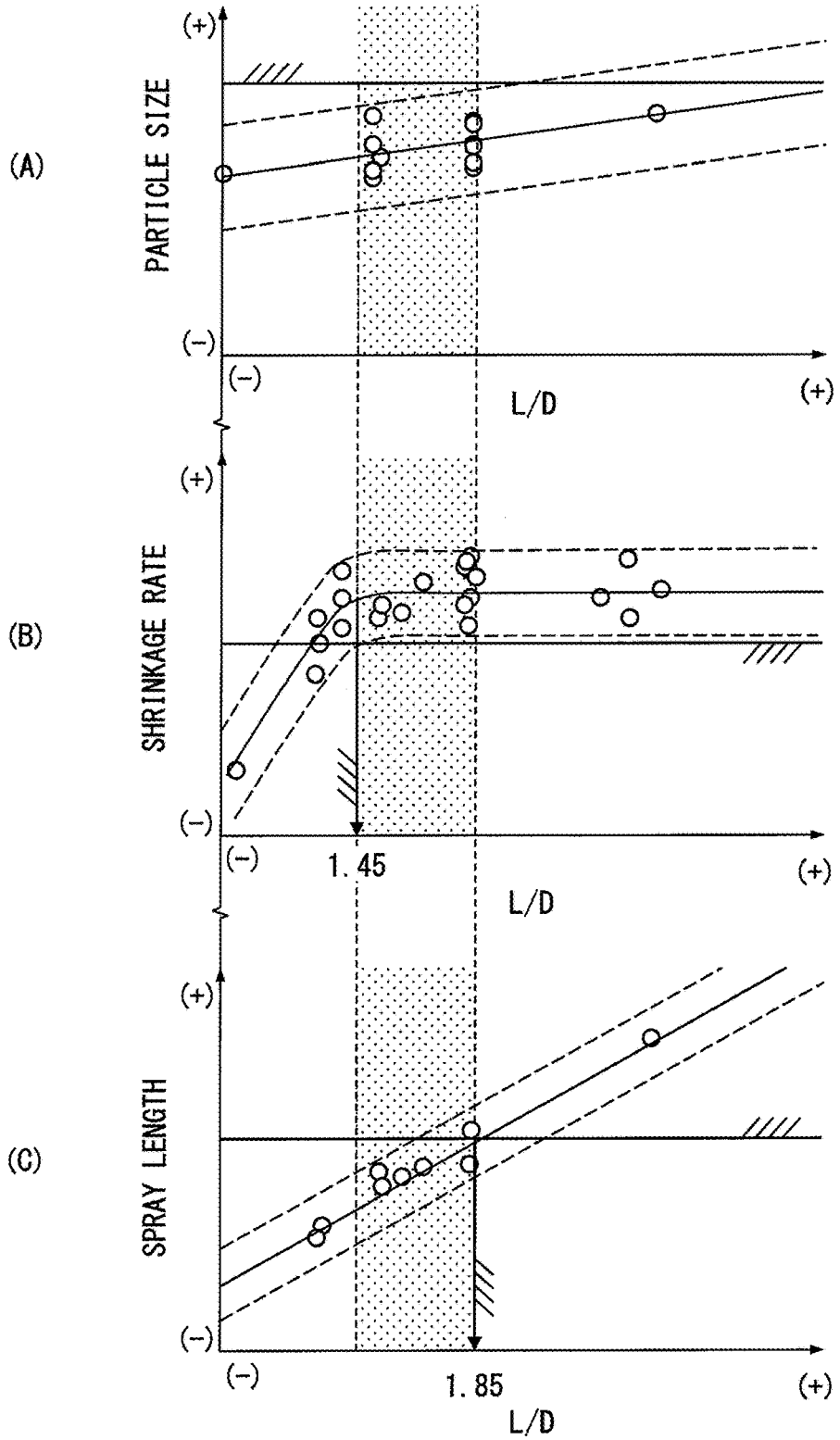
FIG. 6 is a drawing showing the change of the property of the spray accompanying increase/decrease of the L/D value in the injection hole having a cylindrical hole shape.

As shown in the part (A) of FIG. 6, the atomizing property of the spray in the fuel injector 10 is related to the ratio of the flow channel length and the reference inside diameter of the injection hole. More specifically, as the L/D value in the injection hole becomes smaller, the particle size of the spray also becomes smaller. Therefore, the respective L/D values of the respective injection holes 155*a*, 155*b* in the first embodiment are stipulated so that the upper limit of the particle diameter that caused dispersion does not exceed a predetermined value.

In addition, as shown in the part (B) of FIG. 6, the L/D value is related to the shrinkage rate of the spray injected from the injection hole. With respect to this shrinkage rate of the spray, as the value becomes smaller, it expresses that the spray shrinks and hardly diffuses. As the L/D value becomes larger, the flow channel length of the injection hole becomes longer, and therefore the fuel comes to be rectified more. Accordingly, the spray injected is easily formed along the injection hole axis. Because of such a reason, the shrinkage rate of the spray increases as the L/D value becomes larger. However, the shrinkage rate of the spray becomes generally constant when the L/D value exceeds a specific value. Respective L/D values of the respective injection holes 155*a*, 155*b* in the first embodiment are stipulated to be 1.45 or more at which such increase of the spray shrinkage rate saturates.

Further, as shown in the part (C) of FIG. 6, the L/D value is related to the length of the spray injected from the injection hole. As described above, as the L/D value becomes larger, the fuel flowing inside the injection hole is rectified. Therefore, the length of the injected spray becomes longer accompanying increase of the L/D value. Accordingly, the respective L/D values of the respective injection holes 155*a*, 155*b* in the first embodiment are stipulated to be 1.85 or less so that the spray length does not exceed a predetermined value. Here, the predetermined value that determines the upper limit of the spray length is set to such a value that the distal end of the spray does not reach the cylinder wall surface and the piston top face which define the combustion chamber.

In the first embodiment, the respective L/D values of the first injection hole 155*a* and the second injection hole 155*b* are equalized to approximately 1.65 that is the middle value of two boundary values described above (1.45, 1.85). Therefore, even if the reference inside diameters Dn1, Dn2 are different from each other, the atomizing property of the first injection hole 155*a* and the second injection hole 155*b* can approximate to each other. Accordingly, the fuel injector 10 can reduce the dispersion of the particle diameter with respect to the spray injected from the respective injection holes 155*a*, 155*b* also while forming the spray shape suitable to the combustion chamber of the internal combustion engine.

In addition, in the first embodiment, because both of the respective L/D values of the first injection hole 155*a* and the second injection hole 155*b* exceed 1.45, sufficient rectifying action can be caused in the fuel that flows inside the respective injection holes 155*a*, 155*b*. Therefore, the spray injected from the respective injection holes 155*a*, 155*b* is stably formed in the direction the respective injection hole axes 159*a*, 159*b* are directed. According to the above, the change rate of the spray injected from the respective injection holes 155*a*, 155*b* becomes a value that is approximate to each other and stable. Therefore, the fuel injector 10 can stably form the spray of the shape that is suitable to the combustion chamber of the internal combustion engine.

Also, according to the first embodiment, because both of the respective L/D values of the first injection hole 155*a* and the second injection hole 155*b* are 1.85 or less, the event that the fuel flowing inside the respective injection holes 155*a*, 155*b* is rectified excessively can be avoided. Therefore, both of the length of the spray injected from the respective injection holes 155*a*, 155*b* can be suppressed so that the spray does not adhere to the cylinder wall surface and the piston top face. Accordingly, the fuel injector 10 can form the spray that is more suitable to the combustion chamber of the internal combustion engine.

Also, according to the first embodiment, the difference of the respective flow channel lengths Ln1, Ln2 and the wall thickness of the bottom wall 160 is supplemented by the respective expanded diameter holes 164, 165. Therefore, the respective flow channel lengths Ln1, Ln2 can be stipulated so that the respective L/D values in the respective injection holes 155*a*, 155*b* are optimized even when the wall thickness of the bottom wall 160 is constant. As described above, the configuration of arranging the respective expanded diameter holes 164, 165 and adjusting the respective flow channel lengths Ln1, Ln2 is particularly suitable to the fuel injector 10 that optimizes the respective L/D values of the respective injection holes 155*a*, 155*b*.

In addition, according to the first embodiment, because the respective expanded diameter holes 164, 165 are formed on the fuel downstream side of the respective injection holes 155*a*, 155*b*, the event that the flow of the fuel that is going to flow in to the respective injection holes 155*a*, 155*b* is disrupted inside the respective expanded diameter holes 164, 165 can be avoided. Because the fuel inside the sack chamber 154 can be made to flow in smoothly to the respective injection holes 155*a*, 155*b*, the shape of the spray injected from these injection holes 155*a*, 155*b* can be stabilized more.

Furthermore, according to the first embodiment, because the respective expanded diameter holes 164, 165 are disposed coaxially with the respective injection holes 155*a*, 155*b*, the spray injected from the respective injection holes 155*a*, 155*b* can be formed without hitting the inner peripheral wall surface of the respective expanded diameter holes 164, 165. Therefore, the event that the shape of the spray is disrupted because the respective expanded diameter holes 164, 165 have been formed is avoided.

Also, in the first embodiment, the bottom wall 160 corresponds to "injection hole wall".

Second Embodiment

Figure 7:
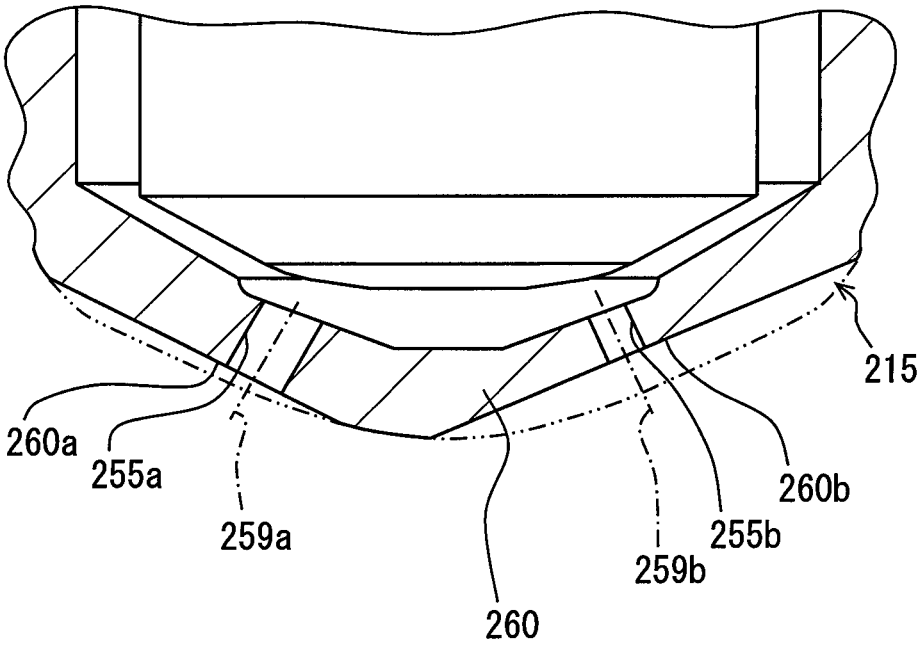
FIG. 7 is a cross-sectional view in which the vicinity of a sack section of a second embodiment is enlarged.
Figure 8:
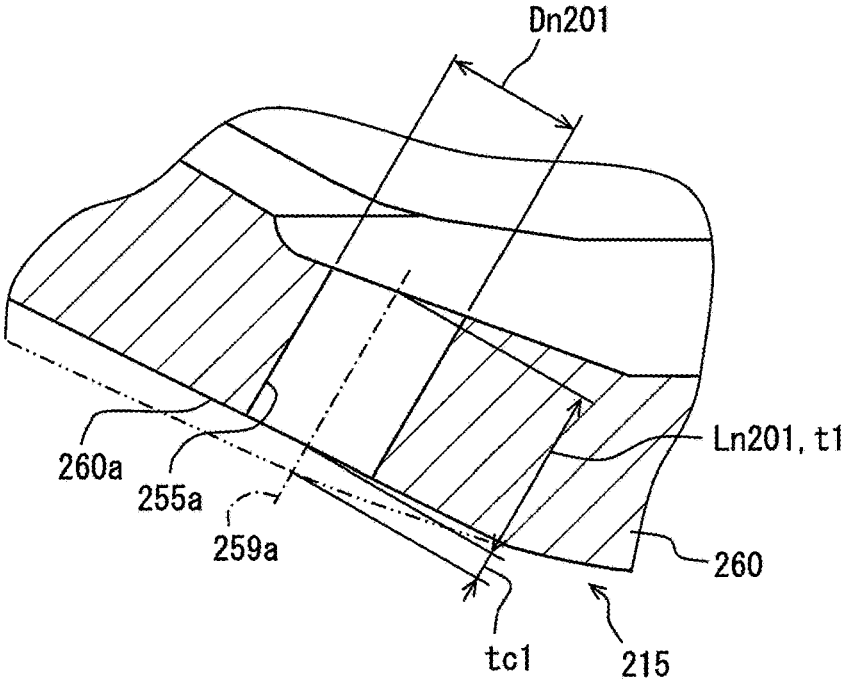
FIG. 8 is a cross-sectional view in which the vicinity of the first injection hole is further enlarged.
Figure 9:
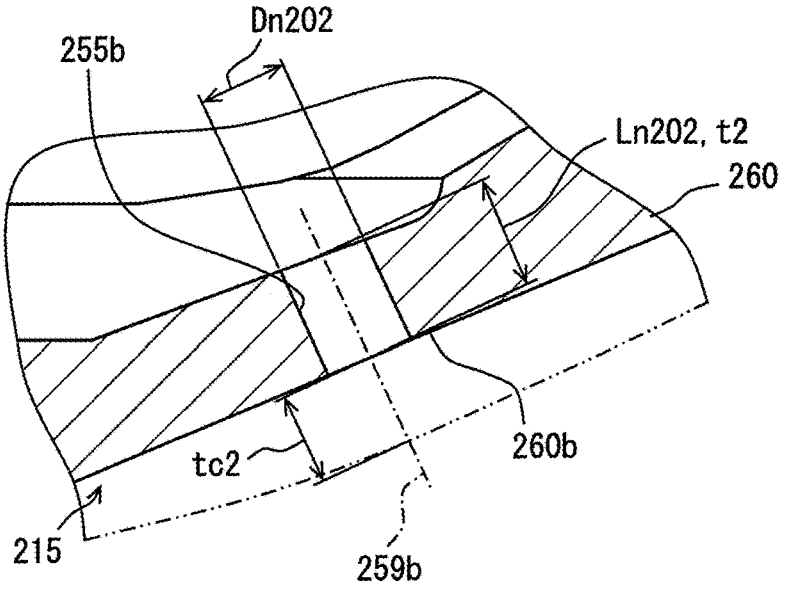
FIG. 9 is a cross-sectional view in which the vicinity of the second injection hole is further enlarged.

A second embodiment of the present invention shown in FIGS. 7 to 9 is a modification of the first embodiment. In a bottom wall 260 of a nozzle body 215 according to the second embodiment, a first injection hole 255*a* and a second injection hole 255*b* are formed which correspond to the respective injection holes 155*a*, 155*b* of the first embodiment (refer to FIG. 2). In the explanation below, out of the bottom wall 260, the region making the first injection hole 255*a* penetrate therethrough is made a first region 260*a*, and the region making the second injection hole 255*b* penetrate therethrough is made a second region 260*b*. In the second embodiment also, the L/D value of the first injection hole 255*a* (=Ln201/Dn201) and the L/D value of the second injection hole 255*b* (=Ln202/Dn202) are set to a same value, and are set to approximately 1.65 for example similarly to the first embodiment.

On the other hand, the bottom wall 260 has not the configuration corresponding to the first expanded diameter hole 164 and the second expanded diameter hole 165 of the first embodiment (refer to FIG. 2). According to the second embodiment, in order to achieve the respective flow channel lengths Ln201, Ln202 of the first injection hole 255*a* and the second injection hole 255*b*, the wall thicknesses of the first region 260*a* and the second region 260*b* are stipulated so as to correspond to the respective flow channel lengths Ln201, Ln202 respectively. Respective wall thicknesses t1, t2 of the first region 260*a* and the second region 260*b* which are different from each other thus are adjusted by machining the outer surface of a nozzle body 215 that is formed to have a substantially constant wall thickness.

More specifically, as shown in FIGS. 8, 9, the thickness tc2 for machining the nozzle body 215 for forming the second region 260*b* is made thicker than the thickness tc1 for machining the nozzle body 215 for forming the first region 260*a*. By such a machining step, the respective injection holes 255*a*, 255*b* are formed which have the flow channel lengths Ln201, Ln202 different from each other. Also, the respective wall thicknesses t1, t2 and the respective machining thicknesses tc1, tc2 described above are stipulated along respective injection hole axes 259*a*, 259*b*.

In the second embodiment also, by equalizing the respective L/D values of the first injection hole 255*a* and the second injection hole 255*b* within a predetermined range, the effect similar to that of the first embodiment comes to be exerted. Therefore, even when reference inside diameters Dn201, Dn202 of the respective injection holes 255*a*, 255*b* may be different from each other, the property of the spray injected from them can be made to approximate to each other.

In addition, the difference of the respective flow channel lengths Ln 201, Ln 202 may be achieved by making the wall thicknesses t1, t2 of the first region 260*a* and the second region 260*b* that make the respective injection holes 255*a*, 255*b* penetrate therethrough differ from each other as the second embodiment. With such a configuration, the possibility of the configuration optimizing the respective L/D values further improves. Also, in the second embodiment, the bottom wall 260 corresponds to "injection hole wall".

Third Embodiment

Figure 10:
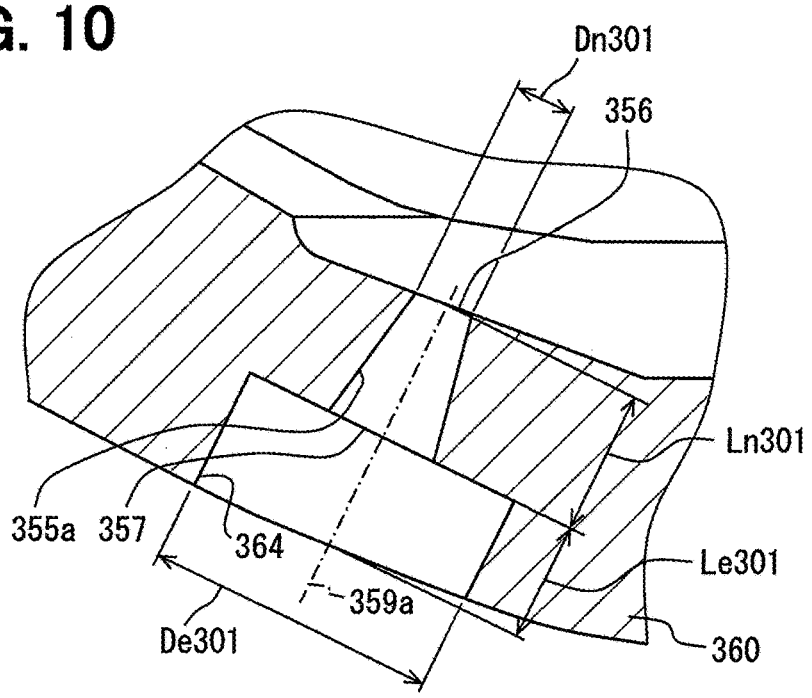
FIG. 10 is a cross-sectional view in which the vicinity of the first injection hole of a third embodiment is enlarged.
Figure 11:
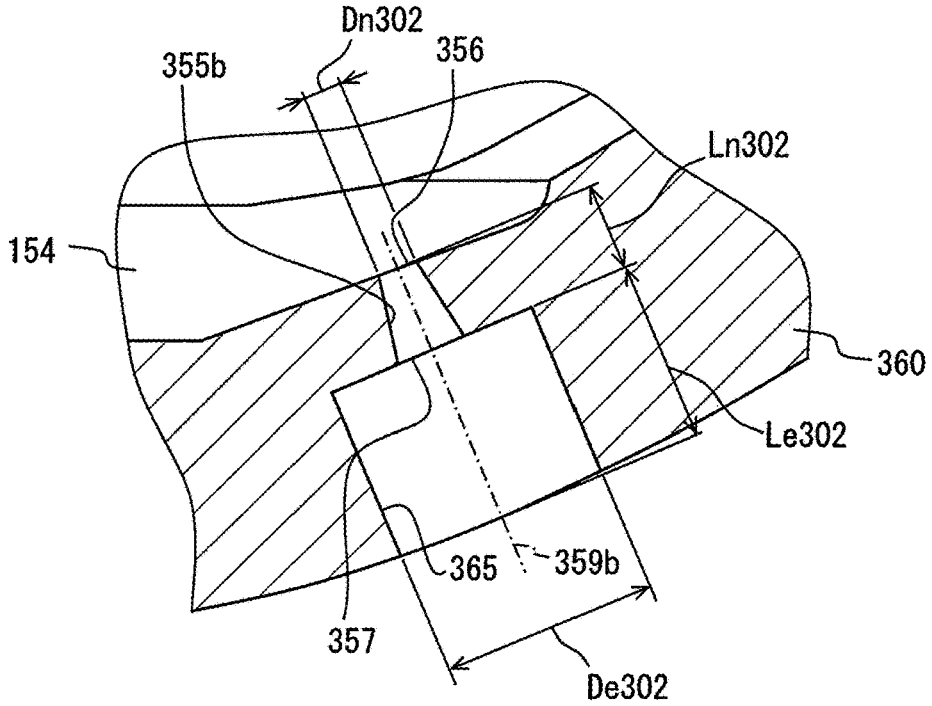
FIG. 11 is a cross-sectional view in which the vicinity of the second injection hole is enlarged.

A third embodiment of the present invention shown in FIGS. 10, 11 is another modification of the first embodiment. In a bottom wall 360 of the third embodiment, a through hole formed of a first injection hole 355*a* and a first expanded diameter hole 364 and a through hole formed of a second injection hole 355*b* and a second expanded diameter hole 365 are formed. The first injection hole 355*a* and the second injection hole 355*b* are formed into a tapered hole shape that expands the diameter from respective reference inside diameters Dn301, Dn302 starting from an inlet side opening 356 toward an outlet side opening 357. In the third embodiment also, the L/D value of the first injection hole 355*a* (=Ln301/Dn301) and the L/D value of the second injection hole 355*b* (=Ln302/Dn302) agree to each other.

On the other hand, the first expanded diameter hole 364 and the second expanded diameter hole 365 correspond to the respective expanded diameter holes 164, 165 of the first embodiment (refer to FIG. 4), and are disposed coaxially on respective injection hole axes 359*a*, 359*b* of the respective injection holes 355*a*, 355*b*. Respective inside diameters De301, De302 of the respective expanded diameter holes 364, 365 are made larger diameters than the respective reference diameters Dn301, Dn302 of the respective injection holes 355*a*, 355*b*. The flow channel length Le301 of the first expanded diameter hole 364 supplements the difference of the flow channel length Ln301 of the first injection hole 355*a* and the wall thickness of the bottom wall 360. Similarly, the flow channel length Le302 of the second expanded diameter hole 365 supplements the difference of the flow channel length Ln302 of the second injection hole 355*b* and the wall thickness of the bottom wall 360.

Next, the L/D value in the injection hole having the tapered hole shape as the respective injection holes 355*a*, 355*b* of the third embodiment will be explained in detail below based on FIG. 12.

Figure 12:
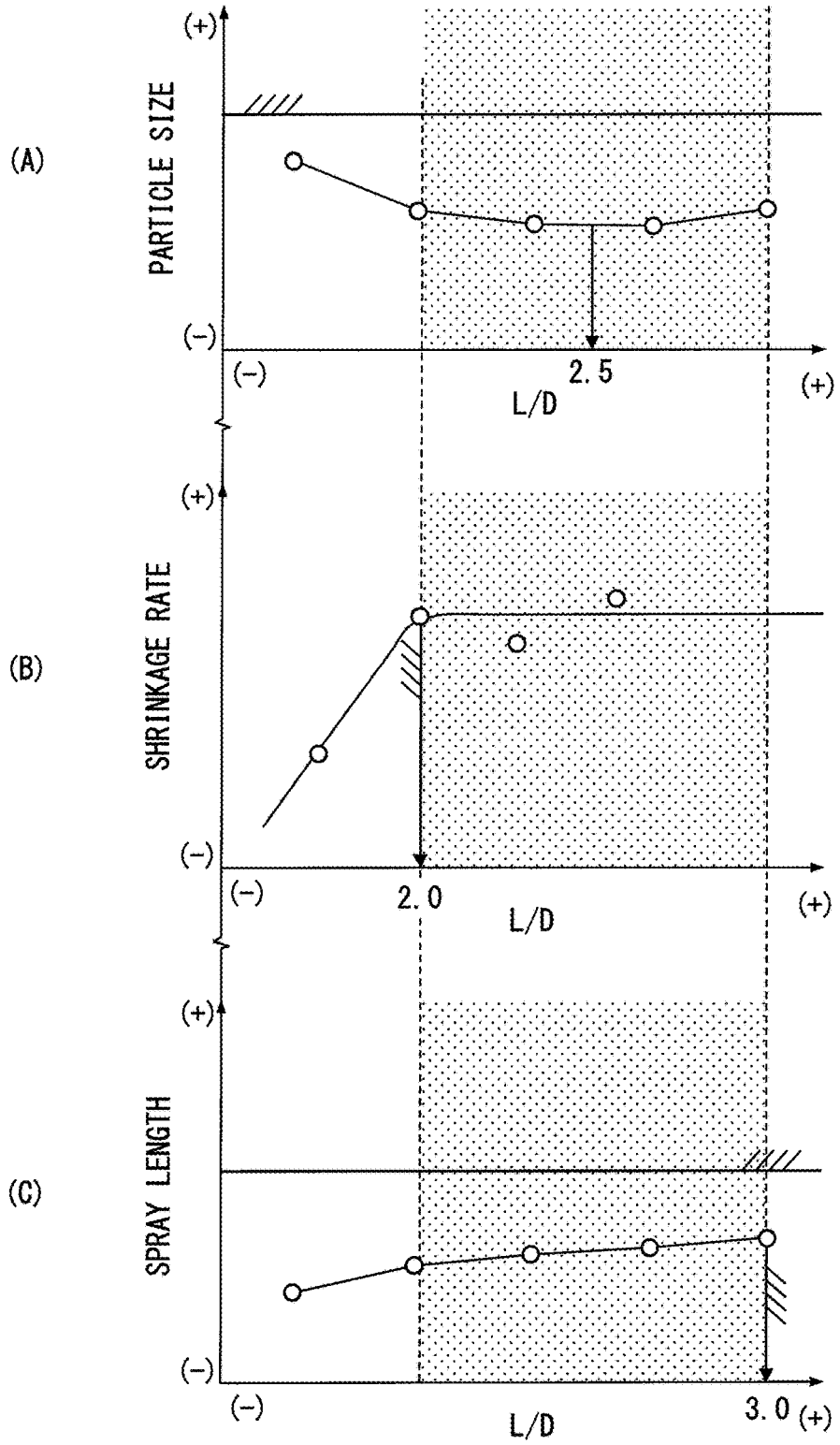
FIG. 12 is a drawing showing the change of the property of the spray accompanying increase/decrease of the L/D value in the injection hole having a tapered hole shape.

As shown in the part (A) of FIG. 12, even if the injection hole has a tapered hole shape, the atomizing property of the spray is related to the L/D value. The particle diameter of the spray in the tapered hole shape becomes small once accompanying that the L/D value becomes small. However, when the L/D value becomes smaller than a predetermined inflection point (L/D value=approximately 2.5), the particle diameter of the spray becomes large gradually. The reason is assumed that the spray region becoming a liquid film is hardly formed because the flow channel length is short. To be more specific, in order to atomize the fuel, it is required to form a region where the fuel becomes a liquid film in the outer peripheral part of the spray. However, when the flow channel length becomes short, the flow of the fuel hardly lines the inner peripheral wall surface of the injection hole of which inside diameter changes. Therefore, the spray region becoming a liquid film is hardly formed and the particle diameter of the spray becomes large. The range of the respective L/D values of the respective injection holes 355*a*, 355*b* in the third embodiment is stipulated so as to sandwich the L/D values described above that show the local minimum value.

As shown in the part (B) of FIG. 12, even if the injection hole has a tapered hole shape, the L/D value is related to the shrinkage rate of the spray injected from the injection hole. The shrinkage rate of the spray in the tapered hole shape becomes generally constant when the L/D value exceeds a specific value similarly to the first embodiment. The respective L/D values of the respective injection holes 355*a*, 355*b* in the third embodiment are stipulated to be 2.0 or more at which such increase of the spray shrinkage rate saturates.

As shown in the part (C) of FIG. 12, the change rate of the length of the spray with respect to the L/D value of the case the injection hole has a tapered hole shape becomes smaller compared to the case the injection hole has a cylindrical hole shape. Therefore, even if the L/D value is increased, the spray length hardly exceeds the predetermined value that stipulates the upper limit of this spray length has been stipulated. Accordingly, the respective L/D values of the respective injection holes 355*a*, 355*b* of the third embodiment are stipulated to 3.0 for example so as to sandwich the local minimum value shown in the part (A) of FIG. 12 to the center jointly with the lower limit value shown in the part (B) of FIG. 12.

In the third embodiment, the respective L/D values of the first injection hole 355*a* and the second injection hole 355*b* are set to approximately 2.5 for example which is a value in the middle of two boundary values described above (2.0, 3.0) and at which the particle diameter of the spray becomes smallest. By setting thus the respective L/D values of the first injection hole 355*a* and the second injection hole 355*b* to within a predetermined range, the effect similar to that of the first embodiment comes to be exerted. Therefore, even when reference inside diameters Dn301, Dn302 of the respective injection holes 355*a*, 355*b* may be different from each other, the property of the spray injected from them can be made to approximate to each other. Also, in the third embodiment, the bottom wall 360 corresponds to "injection hole wall".

Other Embodiments

Although embodiments according to the present invention have been explained above, the present disclosure is not to be interpreted so as to be limited to the embodiments described above, and can be adapted to various embodiments and combinations within the range not departing from the substance of the present disclosure.

According to the embodiments described above, two injection holes having different reference inside diameter were set so that the respective L/D values became equal to each other. However, in three or more injection holes having different reference inside diameter, the respective L/D values may not be the same. In addition, the respective L/D values of the respective injection holes may not be strictly equal to each other, and only have to be set so as to be equal to each other to a degree the property of the spray can be made to approximate to each other. Further, although it is preferable that the L/D values of all injection holes formed in the nozzle body agree to each other, the L/D value of a part of the injection holes may not agree to the L/D values of other injection holes.

According to the embodiments described above, the respective L/D values were stipulated within the range between the upper limit value and the lower limit value which were stipulated based on the shape of the injection hole. However, the respective L/D values of the respective injection holes may agree to each other in the outside of the range between the upper limit value and the lower limit value. Further, the respective L/D values of the respective injection holes may be stipulated to be the values different from each other within the range between the upper limit value and the lower limit value.

In the embodiments described above, the injection holes were arrayed along the same imaginal circle 19 (refer to FIG. 3), however, the positions for arranging the inlet side openings of the injection holes may be changed appropriately according to the required shape of the spray. For example, on the inner peripheral side of the first injection hole having a large diameter, the second injection hole with a small diameter may be disposed. Alternatively, such first injection hole and second injection hole may be arrayed alternately in the peripheral direction. Also, the shape of the individual injection hole may be changed appropriately as far as the injection hole is formed into a shape analog to each other. For example, in the fuel injection hole having the tapered hole shape as the third embodiment, the taper angle of the inner wall surface thereof may be changed appropriately. More specifically, the injection hole may be formed into a tapered hole shape that reduces the diameter from the inlet side opening toward the outlet side opening. In addition, the shape of the cross section of each injection hole may not be a complete round shape, and may be an elliptical shape and the like.

In the first and third embodiments described above, the axial direction of the expanded diameter hole was the same as the injection hole axis. However, the axial direction of the expanded diameter hole may cross the injection hole axis. Also, the center of the expanded diameter hole may be positioned so as to shift from the injection hole axis. Further, the expanded diameter hole is not limited to the cylindrical hole shape as described above, and may be of a tapered hole shape in which the diameter is expanded toward the fuel downstream side, or of a semi-spherical shape in which the outer surface of the nozzle body is recessed, and so on. Furthermore, the expanded diameter hole may be arranged in the form of communicating with the sack chamber in the fuel upstream side of the injection hole instead of the fuel downstream side of the injection hole.

According to the second embodiment described above, the injection holes with different flow channel length were achieved by changing the machining thickness for machining the outer surface of the nozzle body for each region. With such a configuration, the step surface in the radial direction is not formed between the injection hole and the expanded diameter hole. Therefore, the event that the deposit is deposited in the outer peripheral part of the step surface can be avoided. The method of arranging the difference between the wall thickness of the first region and the wall thickness of the second region in the nozzle body thus is not limited to such machining as described above. For example, it is also permissible that the difference of the wall thickness of the first region and the second region has already been arranged at the time of forming the nozzle body. Further, as far as the wall thickness before machining in the first region has already been corresponding to the flow channel length of the first injection hole, only the second region may be formed by machining out of the first region and the second region.

The invention claimed is:

1. A fuel injector that injects fuel from a plurality of injection holes toward an inside of a combustion chamber arranged in an internal combustion engine, wherein the plurality of injection holes include a first injection hole and a second injection hole each of which has a reference inside diameter, each of the first injection hole and the second injection hole has a tapered hole shape that expands the diameter from the reference inside diameter starting from the fuel upstream side toward the fuel downstream side, the plurality of injection holes are provided to an injection hole wall, which is formed with:

a first expanded diameter hole which penetrates the injection hole wall while continuing to the first injection hole, the first expanded diameter hole having a diameter larger than that of the first injection hole; and a second expanded diameter hole which penetrates the injection hole wall while continuing to the second injection hole, the second expanded diameter hole having a diameter larger than that of the second injection hole, the first expanded diameter hole is formed on the fuel downstream side of the first injection hole, and the second expanded diameter hole is formed on the fuel downstream side of the second injection hole.

2. The fuel injector according to claim 1, wherein a flow channel length of the first injection hole greater than a length of the first expanded diameter hole which is along an injection hole axis of the expanded diameter hole.

3. The fuel injector according to claim 1, wherein an imaginarily extended surface of an inner surface of the first injection hole has no intersection with an inner wall surface of the first expanded diameter hole, and an imaginarily extended surface of an inner surface of the second injection hole has no intersection with an inner wall surface of the second expanded diameter hole.

4. The fuel injector according to claim 1, wherein each of the first expanded diameter hole and the second expanded diameter hole has a tubular hole shape, the first expanded diameter hole is positioned coaxially with the first injection hole, and the second expanded diameter hole is positioned coaxially with the second injection hole.

* * * * *